US005148605A

United States Patent [19]

Julia

[11] Patent Number: 5,148,605

[45] Date of Patent: Sep. 22, 1992

[54] FORMING LEVELING TOOL

[76] Inventor: Juan L. Julia, 235 SW. LeJeune Rd., Hialeah, Fla. 33134

[21] Appl. No.: 750,663

[22] Filed: Aug. 27, 1991

[51] Int. Cl.[5] ..... G01C 9/28

[52] U.S. Cl. ..... 33/370; 269/43; 269/54.1; 269/236

[58] Field of Search ..... 33/370; 269/43, 53, 269/54, 54.1, 236; 254/11

[56] References Cited

U.S. PATENT DOCUMENTS

| | | | |
|---|---|---|---|
| 874,151 | 12/1907 | Zeiser | 269/43 |
| 1,651,041 | 11/1927 | Richards | 269/43 |
| 2,045,307 | 6/1936 | O'Connell | 269/43 |
| 3,161,964 | 12/1964 | Myles | 33/370 |
| 3,201,874 | 8/1965 | Christy | 269/43 |
| 3,266,155 | 8/1966 | Staub | 33/370 |
| 4,322,064 | 3/1982 | Jarvis | 269/43 |
| 4,350,279 | 9/1982 | Haley | 269/43 |
| 4,704,829 | 11/1987 | Baumker, Jr. | 269/43 |
| 4,843,726 | 7/1989 | Ward | 269/43 |
| 4,958,814 | 9/1990 | Johnson | 269/43 |

FOREIGN PATENT DOCUMENTS

| | | | |
|---|---|---|---|
| 3209984 | 5/1983 | Fed. Rep. of Germany | 269/43 |

*Primary Examiner*—Thomas B. Will
*Attorney, Agent, or Firm*—Jesus Sanchelima

[57] ABSTRACT

A tool for mounting and leveling forming boards to a vertical wall that has three legs parallel to each other. Two of these legs are separated sufficiently to permit a forming board only between them while the third leg is separated a larger distance and typically the distance between two spaced apart forming boards. A puncturing mechanism is mounted to the outer leg of the pair that accepts the forming board so that it can be releasably held. A leveling device is mounted on a transverse member that connects all three legs.

1 Claim, 3 Drawing Sheets

FORMING LEVELING TOOL

BACKGROUND OF THE INVENTION

Field of the Invention

The present invention relates to tools utilized to mount flat and substantially elongated boards to a vertical wall and more particularly to such tools that permit the user to hold and level said boards.

In the building construction industry carpenters typically form the cavities where the concrete is going to be pouring with two sheets of plywood that are kept at a spaced apart relationship to each other and in more instances the sheets need to be leveled. This task becomes particularly difficult when a carpenter needs to mount one of such boards, typically plywood, to an outer surface of a wall. If scaffolds are not used, a helper is required to hold the board to be mounted in place while the carpenter drives the first nail through. The difficulty increases with the height of the wall and the size of the board is to be mounted. Even if scaffolds are used, a helper is typically required.

SUMMARY OF THE INVENTION

It is one of the main purposes of the present invention to provide a tool that can be readily mounted to an elongated flat board or sheet of plywood to be used as a forming element in order to keep it in place until a user permanently affixes it to the surface of a wall.

It is another purpose of the present invention to provide such a tool that can permit the vertical adjustment of its position with respect to end of the wall where the forming is taking place in order to take into account all the subsequent activities such as the pouring of a slab of concrete.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
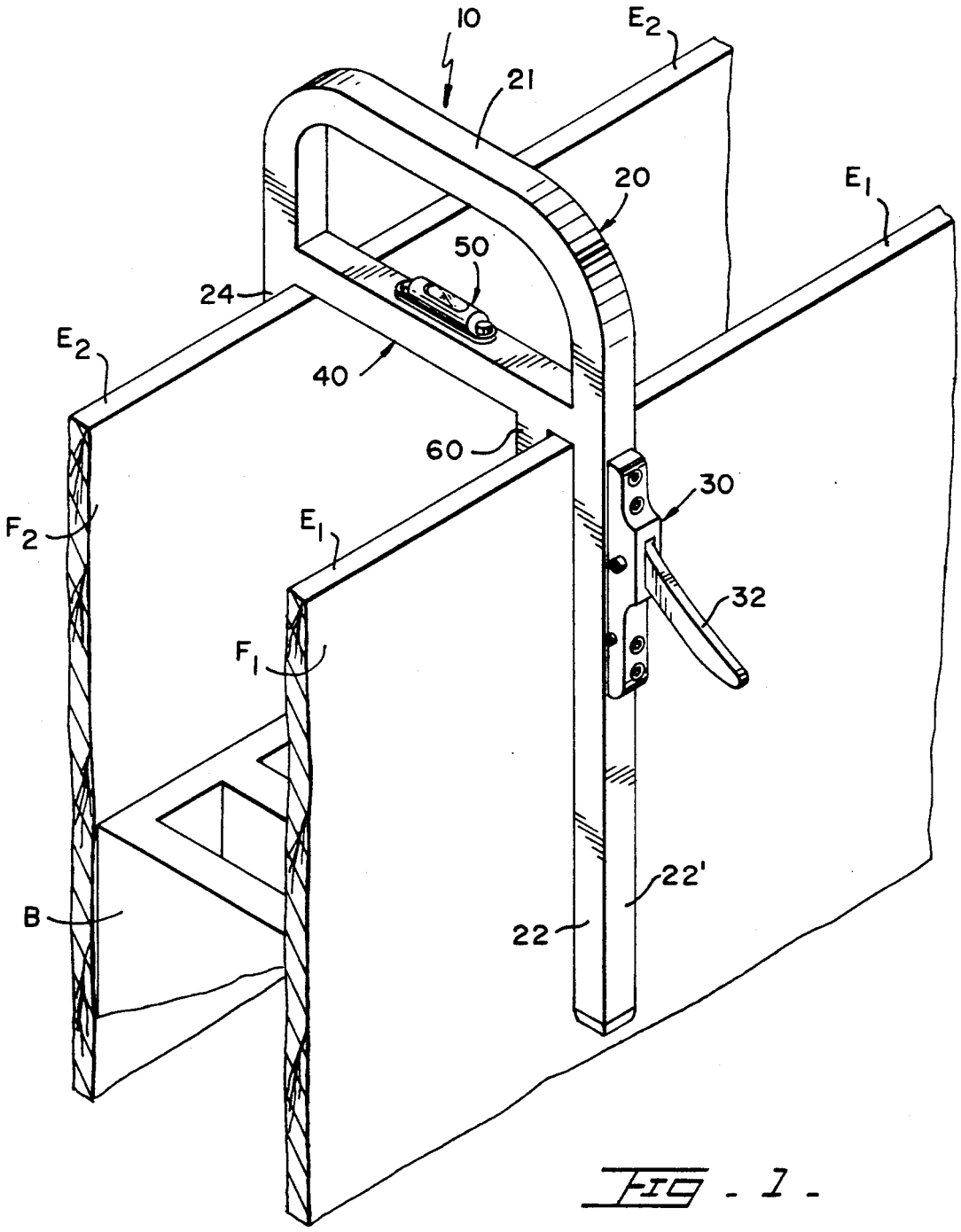
FIG. 1 represents an isometric view of one of the embodiments of the present invention mounted to an elongated flat board to be used as a forming element in construction.

Referring now to the drawings, where the present invention is generally referred to with numeral 10.

The present invention is preferably made out of rigid material, such as steel, and it includes a U-shaped assembly 20 that has long leg 22 and short leg 24 that are of sufficient length to securely ride on top of forming boards $F_1$ and $F_2$.

Figure 2:
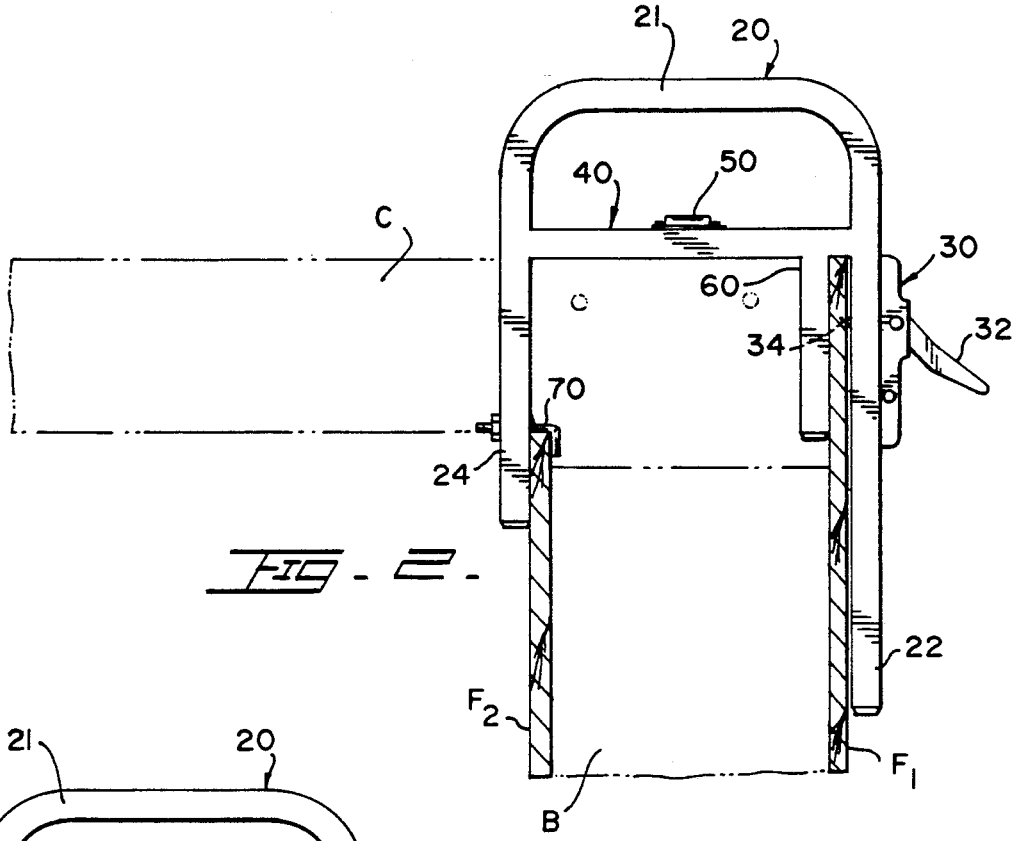
FIG. 2 is an elevational front view of the present invention being adjusted for the pouring of a slab.
Figure 3:
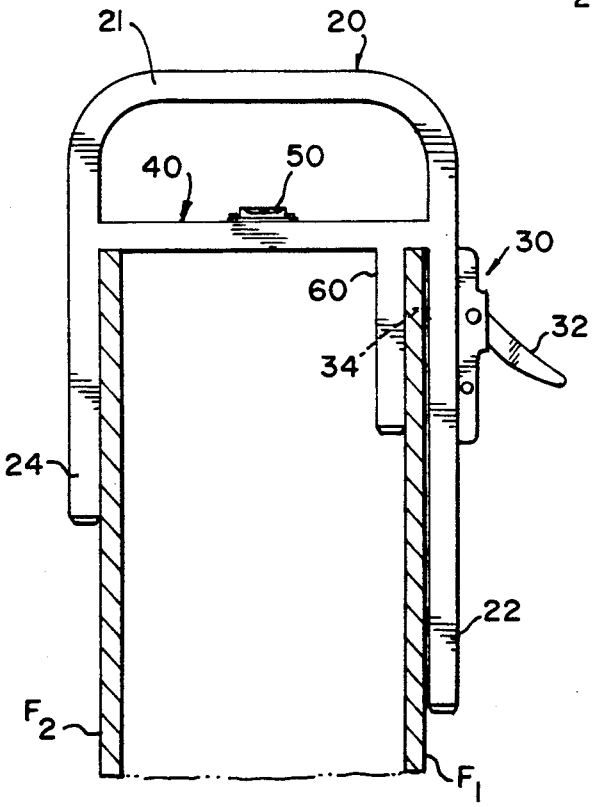
FIG. 3 shows an elevational front view of the present invention being used to pour a tie-beam.

Long leg 22 includes puncturing assembly 30 mounted on the outer surface 22' of leg 22. Assembly 30 includes actuating lever 32 so designed and constructed to cammingly push in pointed member 34 inwardly to effectively engage forming board $F_1$, as best seen in FIGS. 2 and 3. Transversal member 40 is rigidly and perpendicularly mounted to legs 22 and 24. Shorter leg 24 can be made of the same size as leg 22, however, it has been found that it is easier to handle tool 10 for reading mounting it and demounting it. The separation of legs 22 and 24 is sufficient to permit the mounting of device 10 on forming boards $F_1$ and $F_2$ according to the width of the wall which will be determined by the width of the block.

Transversal member 40 includes level assembly 50 that permits a user to determine whether the upper edge $E_1$ board $F_1$ being installed is at a leveled position with respect to already installed and leveled board $F_2$ and prior to driving in the first few nails to permanently secure forming boards $F_1$ to concrete blocks B.

It is to be understood that U-shaped assembly 20 can also have a slight different shapes without departing from the spirit of the invention if basically two legs 22 and 24 and inner leg 60 relatively closer to leg 22 are mounted to a spacer or transversal member 40 so that it can ride on forming boards $F_1$ and $F_2$. The upper end 21 of assembly 20 functions as a handle. The same is true as to the cross-section of assembly 20 or the material it is made out of can also be substituted with any other rigid material. In the preferred embodiment the cross sectional shape of assembly 20 is square or rectangular so that the surfaces adjacent to boards $F_1$ and $F_2$ are positioned flat against the latter.

Sometimes the pouring of a slab requires that the position of device 10 be offset in the vertical direction to allow for such operation as shown in FIG. 2. L-shaped screw member 70 can be utilized to provide supporting engagement that will permit transversal member 40 to align its lower surface with the upper surface of the concrete slab C to be poured.

In FIG. 3, conventional forming boards $F_1$ and $F_2$ are being used to pour a tie beam. In operation, tool 10 is secured to forming board $F_1$ ($F_1$ is on the outside) through the engagement of pointed member 34 into board $F_1$.

Figure 4:
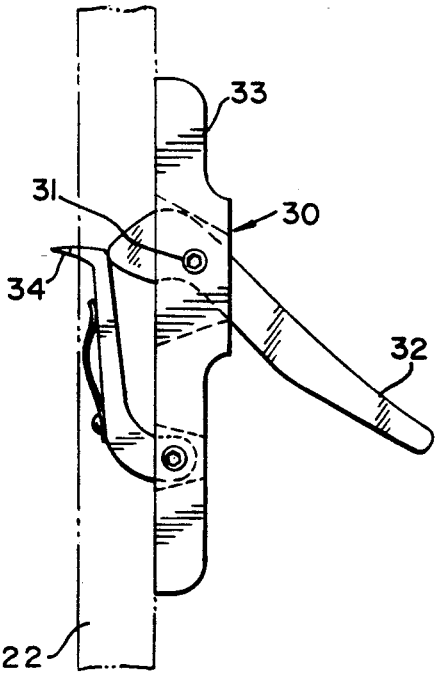
FIG. 4 is a detail side view of the puncturing assembly.

Puncturing assembly 30 is preferably implemented as shown in FIG. 4. Lever 32 cammingly causes the inward motion of pointed member 34 to securely hold board $F_1$. Lever 32 is designed to be pivotally mounted to pin 31 inside housing 33.

Figure 5:
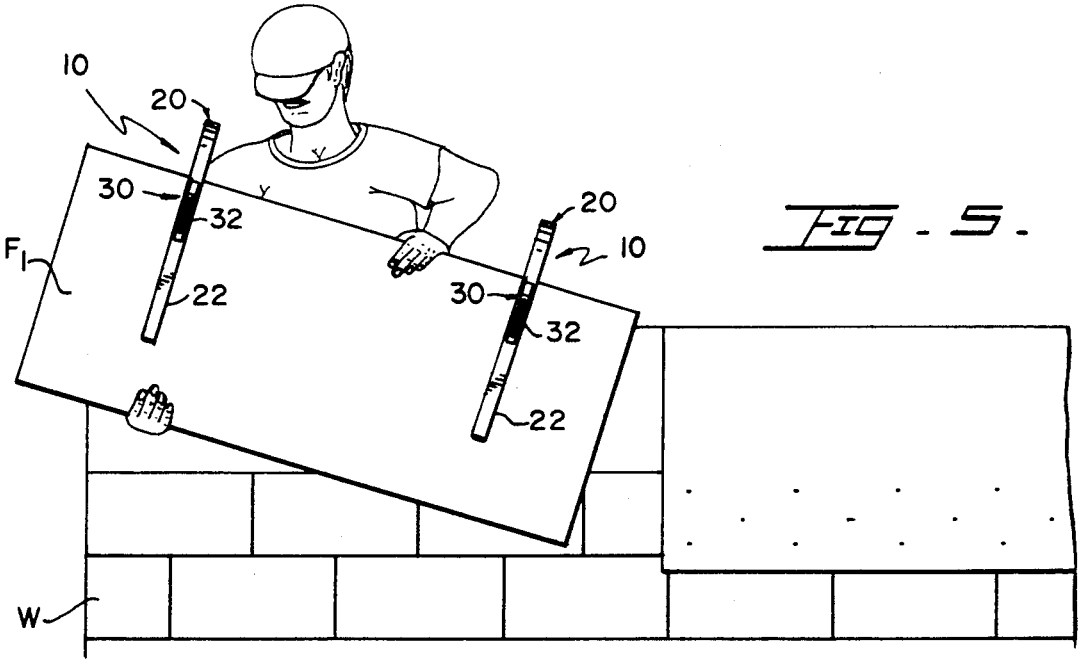
FIG. 5 illustrates how a user mounted a forming board on the exterior surface of a wall.
Figure 6:
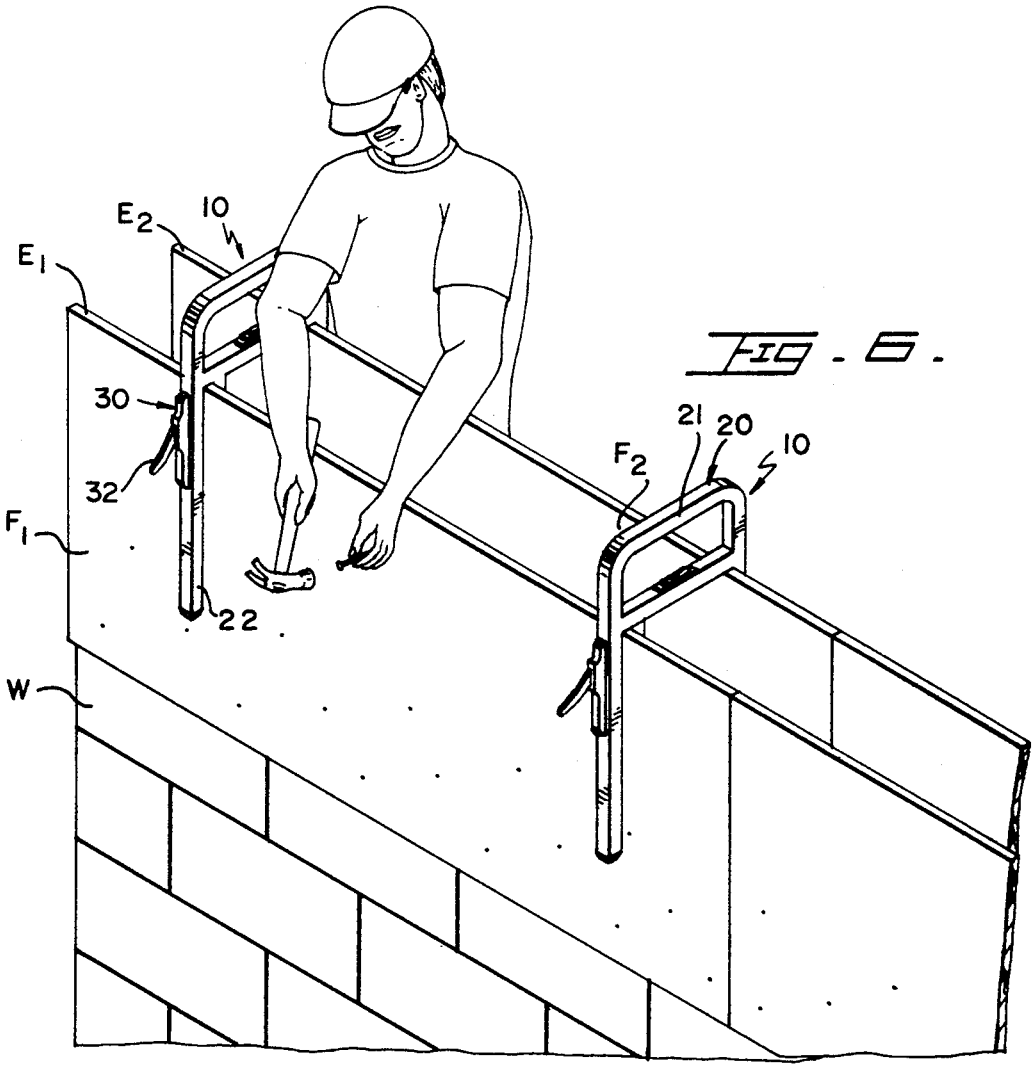
FIG. 6 shows how a user finalizes the mounting of the board.

As it can be seen from FIGS. 5 and 6, a user can use the present invention to single handedly install forming board $F_1$ to an exterior wall surface. This becomes increasingly useful when the surface is at high floors and there are no scaffold. A user basically mounts tool 10 to board $F_1$ on the floor and swings over (already attached) wall W, as shown in FIG. 5. The internal forming board $F_2$ is already installed. The user then causes leg 24 to abuttingly mount adjacent to the inner (inside the building) surface of board $F_2$. Transverse member 40 rests on edge $E_2$. A user can check leveling assembly 50 to make sure that edges $E_1$ and $E_2$ are leveled, then he or she proceeds to drive the nails (or any other fastening device) through board $F_1$ and into wall W.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A tool for mounting and leveling forming boards to a vertical wall, comprising:

A. first and second leg members having each two ends wherein said first leg member is longer than said second leg member;

B. a transverse member rigidly and perpendicularly mounted to one of the ends of each of said leg members;

C. a puncturing assembly mounted to said first leg member and further including a puncturing element that is selectively forced inwardly to puncture one of said boards holding same securely in place;

D. a third leg member rigidly and perpendicularly mounted to said transverse member and said third leg member being mounted at a parallel and spaced apart relationship with respect to said first member so that separation of said third and first leg members is sufficient to permit said one of said forming boards through and wherein said third leg member is shorter than said first and second leg members;

E. handle means mounted to said transverse member; and

F. level means longitudinally mounted along said transverse member.

* * * * *